United States Patent [19]

Popp

[11] Patent Number: 5,035,572

[45] Date of Patent: Jul. 30, 1991

[54] ARRANGEMENT FOR ADJUSTING GUIDE BLADES

[75] Inventor: Joachim Popp, Dachau, Fed. Rep. of Germany

[73] Assignee: MTU Motoren-und Turbinen-Union Munchen GmbH, Fed. Rep. of Germany

[21] Appl. No.: 508,173

[22] Filed: Apr. 12, 1990

[30] Foreign Application Priority Data

Apr. 21, 1989 [DE] Fed. Rep. of Germany ..... 3913102

[51] Int. Cl.[5] ..... F01D 9/00; F01D 17/00

[52] U.S. Cl. ..... 415/12; 415/150; 415/156; 415/160

[58] Field of Search ..... 415/148, 150, 151, 156, 415/159, 160, 161, 162, 163, 134, 137, 138, 139, 12

[56] References Cited

U.S. PATENT DOCUMENTS

| | | | |
|---|---|---|---|
| 2,305,311 | 12/1942 | Jendrassik | 60/39.27 |
| 2,697,326 | 12/1954 | Featonby | 60/39.25 |
| 2,809,803 | 10/1957 | Featonby | 415/12 |
| 2,929,546 | 3/1960 | Wilkes, Jr. | 415/150 |
| 2,932,440 | 4/1960 | Hemsworth | 415/156 |
| 3,038,698 | 4/1962 | Troyer | 415/12 |
| 3,628,329 | 12/1971 | Spencer | 60/39.29 |
| 3,904,309 | 9/1975 | Keetley | 415/148 |
| 4,439,982 | 4/1984 | Weiler et al. | 415/139 |
| 4,619,580 | 10/1986 | Snyder | 415/12 |

FOREIGN PATENT DOCUMENTS

| | | | |
|---|---|---|---|
| 628826 | 10/1961 | Canada | 415/12 |
| 193396 | 4/1986 | Japan . | |

*Primary Examiner*—Edward K. Look
*Assistant Examiner*—Hoang Nguyen
*Attorney, Agent, or Firm*—Evenson, Wands, Edwards, Lenahan & McKeown

[57] ABSTRACT

An arrangement for adjusting guide blades by thermal expansion has an expansion rod which has a significantly different coefficient of linear expansion with respect to the supporting housing and is aligned in the circumferential direction of the turbo-engine and is connected with an adjusting ring by way of a step-up lever. As a result, a guide blade adjustment can be achieved easily as a function of the working gas temperature.

28 Claims, 2 Drawing Sheets

FIG. 2
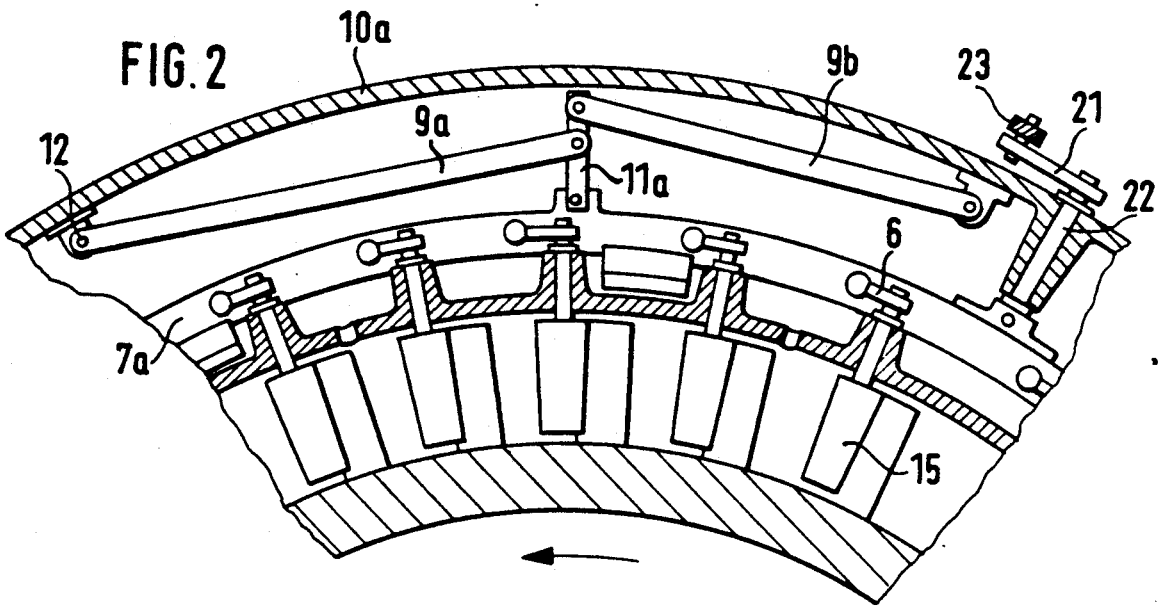
FIG. 1
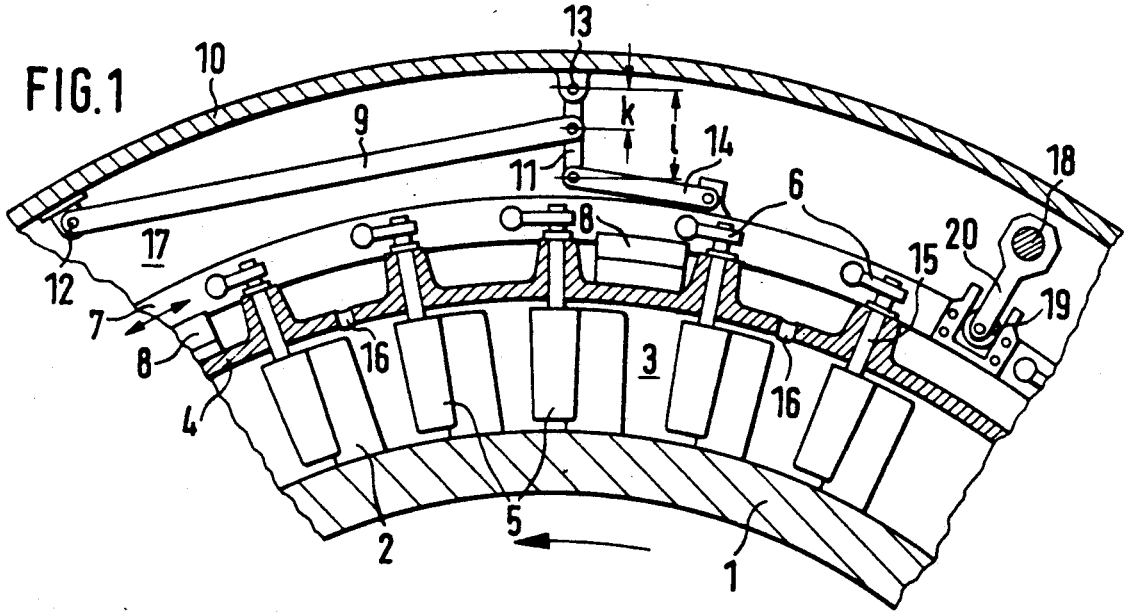
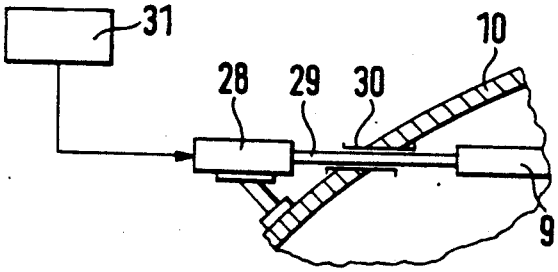
FIG. 5

ARRANGEMENT FOR ADJUSTING GUIDE BLADES

BACKGROUND AND SUMMARY OF THE INVENTION

The invention relates to an arrangement for adjusting guide blades in a turbo-engine by means of the thermal expansion of an expansion rod acted upon by working gas, this expansion rod, at one end, being stationarily mounted to a supporting housing and, at its other end, being linked to the short lever arm of a step-up lever pivoted in the supporting housing.

It is known to let the adjustment of guide blades be controlled as a function of the temperature of the working gas, in which case an external control of the engine control unit may be superimposed on this control circuit. Adjusting arrangements of this type have become known, for example from U.S. Pat. Nos. 3,377,799, 3,628,329 or 4,391,093, in which a rod is axially movably arranged inside a perforated sleeve. In this case, working gas from the compressor flows around the sleeve so that, in the case of temperature changes, the sleeve first expands with respect to the internally extending rod. This expansion difference is used for adjusting the guide blades. After some time, the rod disposed in the interior of the perforated sleeve is also heated by the working gas flowing in by way of the bores so that the relative expansion between the rod and the sleeve becomes zero again. This adjustment is therefore suitable for controlling transient processes. According to these previously known arrangements, the transmission of the expansion difference to the guide blades takes place in that the arrangement is connected into the reaction circuit of a blade adjusting circuit. For this purpose, the arrangement is inserted into a wire cable control provided for determining the actual blade position and thus, when the adjusting arrangement is actuated, an intentional falsification is carried out of the actual-value transmitter for the control arrangement.

Based on this known arrangement, it is an object of the present invention to develop an adjusting arrangement of the above-mentioned type such that it permits a direct adjustment of the guide blades without the connecting of a separate control circuit.

According to the invention, this object is achieved by means of an arrangement wherein the expansion rod has a significantly different coefficient of linear expansion with respect to a supporting housing and wherein the step-up device is connected with a guide-blade-coupled adjusting ring.

The arrangement according to the invention has the significant advantage that a direct adjustment of the guide blades can be carried out without any connecting of an external control circuit. This results in shorter reaction times as well as in a reduced risk of system errors. The adjustment takes place strictly mechanically and is therefore advantageously independent of electric, hydraulic or other components. In addition, the arrangement distinguishes itself by its extremely simple construction.

As a result,

- the number of parts, the manufacturing and logistics costs are drastically reduced;
- the assembly and the maintenance is shortened and simplified;

- the breakdown risk of electric, hydraulic components of the control circuit is eliminated and that of the mechanical components is minimized.

It is an additional advantage that the arrangement reacts without any problems and delays, for example, to load changes of the engine as a result of the fact that the working gas directly flows around it. Because of the direct mechanical transmission of the "differential expansion change=load change" signal to the adjusting guide blades, the known delays in the electric, hydraulic or other control elements of the control circuit are also eliminated.

Preferably, the long lever arm of the step-up device constructed as a step-up lever is connected with the control ring by way of a similarly linked connecting shaft, in which case the connecting shaft may be manufactured of the same material as the expansion rod and can therefore also function as an expansion rod. However, in this case, it does not have the same effect as the primary expansion rod because its change of length cannot be multiplied by the step-up factor of the step-up lever. In this case, it is possible to construct the step-up device as a one- or two-armed lever or as meshing toothed wheels.

The expansion rod preferably has reinforcing ribs for protecting against buckling, whereby, at the same time, its surface is enlarged and a faster heating and cooling can take place. Longitudinal reinforcing ribs of this type may also be mounted at the connecting shaft.

The step-up lever is preferably constructed to be one-armed and is radially aligned in the supporting housing or in the turbo-engine. In this case, the fulcrum of the step-up lever may be provided on the outside or on the inside, depending on which solution causes less weight or can be carried out more easily constructively.

For generating expansion differences, working gas flows around the expansion rod. Particularly suitable are spaces through which this working gas flows permanently, such as blowing-off spaces of compressors for cooling air or blocking air because short reaction times can be achieved as a result of the high heat transmission value of the flowing medium/expansion rod. It is also possible to provide suitable guide plates by means of which the air blown off the compressor is guided directly to the expansion rod, therefore also making it possible to advantageously shorten reaction times.

Another advantageous development of the invention provides that the arrangement is coupled with several adjusting rings of different compressors or compressor stages. This is possible because the adjustable guide blade stages which are situated behind one another generally must be adjusted in a synchronized manner if a displacement has occurred of the compressor working point. One possibility of coupling different adjusting rings consists of connecting these adjusting rings by way of a rotatable shaft, in which case this shaft may be linked either directly to the step-up lever or indirectly to the adjusting ring coupled to the step-up lever. An alternative coupling possibility consists of coupling several adjusting rings by way of a common push rod, an adapting lever having a defined transmission ratio of its lever arms being provided between each adjusting ring and the push rod. This makes it possible to control every guide blade stage corresponding to its individual flow data. It is also possible in this case to construct the shaft or the push rod to be bendable in order to be able to transmit the adjusting motion also in the case of unfavorable housing data.

For the functioning of the arrangement according to the invention, it is necessary that the expansion rod, or the connecting shaft, has a significantly different coefficient of thermal expansion than the surrounding supporting housing. In this case, the coefficient of thermal expansion of the expansion rod may be much larger or significantly smaller than that of the supporting housing. It was found that the ratio of the two coefficients of linear thermal expansion should be at least 2, in which case much higher values can be achieved by a suitable selection of material. Preferred materials for the supporting housing are, for example, X10, 17-4 PH which have an $\alpha$ of approximately $11\times10^{-6}$/K. A suitable material for the expansion rod is EPC10 or INCO 904 with an $\alpha$ of approximately $4\times10^{-6}$/K. It is also conceivable to manufacture the expansion rod from a fiber-reinforced ceramic material, since this material definitely has a low coefficient of thermal expansion of less than $4\times10^{-6}$/K.

Another advantageous development provides that the arrangement is arranged in the area of a high-pressure compressor and by way of a push rod or a shaft is coupled with adjusting rings of a low-pressure compressor. Thus, frequently only the front stages of a compressor, particularly the stages of a low-pressure compressor are equipped with adjustable guide blades while the last blade rows of a high-pressure compressor have only rigid guide blades. On the other hand, air is frequently branched off as blocking air or cooling air in the area of the last high-pressure compressor stages so that it is appropriate to arrange the adjusting arrangement according to the invention in the area of the high-pressure compressor.

The invention may be arranged within the framework of axial compressors, radial compressors or combined axial and radial compressors, in which case a coupling of the guide blades of the radial and the axial compressor also makes sense. It is also possible to use the invention within the framework of the turbine guide blade adjustment, in which case the expansion rod is preferably acted upon by working gas which is branched off behind the turbine stage.

In an embodiment of the invention, the step-up lever, with its fulcrum, is linked in the supporting housing, resulting in the thermally caused angle of rotation of the adjusting ring caused by the change of length of the expansion rod with respect to the supporting housing, multiplied by the step-up ratio of the step-up lever. An alternative construction of the invention provides that the step-up lever is linked directly to the adjusting ring, and two expansion rods are linked to it which are stationarily mounted at one end. Two expansion rods are therefore provided in this construction resulting in a larger angle of rotation of the adjusting ring with otherwise identical parameters. In this case, it is possible to manufacture both expansion rods with approximately the same coefficient of linear expansion; i.e., that both consist of the same material. In this case, the expansion rods will be arranged on both sides of the step-up lever. As an alternative, it is also possible to use two expansion rods with significantly different coefficients of linear expansion. In this case, both expansion rods will be arranged on the same side of the step-up lever.

Another advantageous development of the invention provides that the pivot of the stationarily linked end of the expansion rod can be displaced in the expansion direction relative to the supporting housing by means of an adjusting motor. This makes it possible to carry out a superimposing adjustment of the guide blades independently of the adjustment controlled by the temperature, for example, by way of the electronic engine control unit. It is also possible to construct the fulcrum of the step-up lever to be displaceable instead of changing the stationary pivot of the expansion rod. The adjusting motor in this case may be constructed to be hydraulic, pneumatic or electric.

Other objects, advantages and novel features of the present invention will become apparent from the following detailed description of the invention when considered in conjunction with the accompanying drawings.

BRIEF DESCRIPTION OF THE DRAWINGS

FIG. 1 is a cross-sectional schematic view of a turbo-compressor, with a blade adjusting arrangement constructed according to a preferred embodiment of the invention;

FIG. 2 is a cross-sectional schematic view of another turbo-compressor, with a blade adjusting arrangement constructed according to another preferred embodiment of the invention;

FIG. 5 is a view of an adjusting motor for an expansion rod.

DETAILED DESCRIPTION OF THE DRAWINGS

Figure 4:
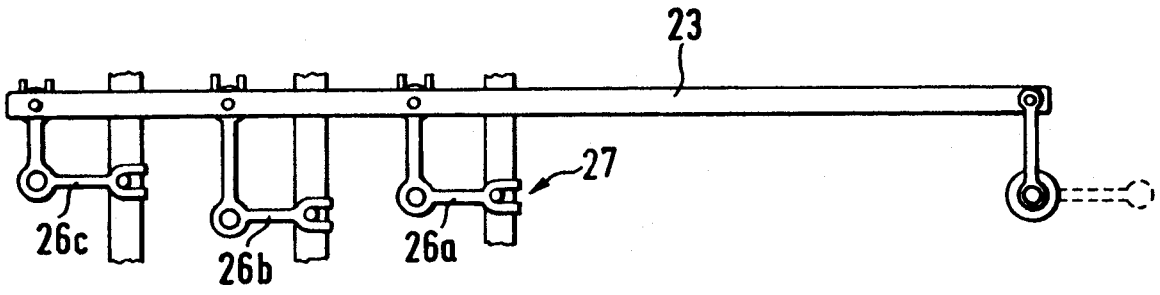
FIG. 4 is a top schematic view of a push rod from the embodiment of FIG. 3.

The cross-sectional view in FIG. 1 through the compressor of a turbo-engine shows a compressor rotor 1 at which radially aligned compressor rotor blades 2 are mounted which are distributed over the circumference. An annular flow duct 3 through which working gas flows in the direction of the normal line of the drawing during the operation, has the compressor rotor 1 as its inside boundary and the flow duct wall 4 as its outside boundary. Guide blades 5 which are uniformly distributed over the circumference are pivotally mounted in this flow duct wall 4. The pivotal movement of the guide blades 5 is achieved by the fact that they are connected with pivoted levers 6 which, in turn, are mounted in an adjusting ring 7 which can be rotated in the circumferential direction so that they can be freely moved several degrees. In this case, the adjusting ring 7 is disposed on the housing 4 by means of guide rails 8 which may also be supported by rollers for damping the friction.

The adjustment of the adjusting ring 7 by means of the gas temperature takes place by means of the fact that an expansion rod 9, with one of its ends, is mounted at a supporting housing 10 by means of a swivel joint 12 and, with its other end, is linked to a step-up lever 11.

The step-up lever 11, with its fulcrum 13, is rotatably disposed in the supporting housing 10. It has a short lever arm k to the linking point of the expansion rod 9, and a long lever arm 1 to the linking point of a connecting shaft 14. In this case, the l/k ratio is preferably to be selected to be larger than 3. The connecting shaft 14 is used for coupling the adjusting ring 7 to the step-up lever 11.

The adjustment of the guide blades 5 by the hot gas according to the invention takes place by means of the fact that by way of openings 16 in the flow duct wall 4, working gas from the flow duct 3 can reach the outer space 17. In the process, the expansion rod 9 is heated to the working gas temperature, whereby it takes up a length determined by its coefficients of linear expansion. At the same time, the supporting housing 10 is heated by the working gas. However, in this case, a heat expansion takes place that differs from that of the expansion rod 9 because of the fact that the supporting housing 10 has a significantly different coefficient of linear expansion. As a result, therefore, a relative expansion takes place between the expansion rod 9 and the supporting housing 10 which, in turn, increased by means of the step-up lever 11, via the connecting shaft 14, is applied to the adjusting ring. Preferably the working gas located in the outer space is transmitted further for the cooling of turbine components, as blocking air for bearing chamber sealing or for ventilating the cabin.

A shaft 18 is also shown which is coupled with the adjusting ring 7 by way of a linked lever 20 equipped with a roller 19 and which goes along in the movement forced on the adjusting ring 7. The rotation of the shaft 18 is used for the control of additional adjusting rings which, by means of analogous coupling devices 19, 20 is mounted at additional adjusting rings.

The embodiment of the invention shown in FIG. 2 corresponds essentially to that of FIG. 1 with the difference that the step-up lever 11*a* is no longer pivotally connected in the supporting housing 10*a*, but at the adjusting ring 7*a*. In addition two expansion rods 9*a* and 9*b* are linked to the step-up lever 11*a* and both have approximately the same coefficient of linear expansion. With their other end, the expansion rods 9*a* and 9*b* are each linked to be rotatable with respect to the supporting housing 10*a*. In this construction, the changing of the position of the adjusting ring 7*a* takes place by means of the fact that both expansion rods 9*a* and 9*b* change in their axial course and thus lead to a position change of the step-up lever 11*a*.

The adjusting ring 7*a* also actuates a pivoted lever 21, the shaft 22 of which (analogously to the shafts 15 of the guide blade 5 by way of pivoted lever 6) is connected with the adjusting ring 7*a*. At the pivoted lever 21, a push rod 23 is mounted which is connected to additional adjusting rings of other rows of guide blades.

Figure 3:
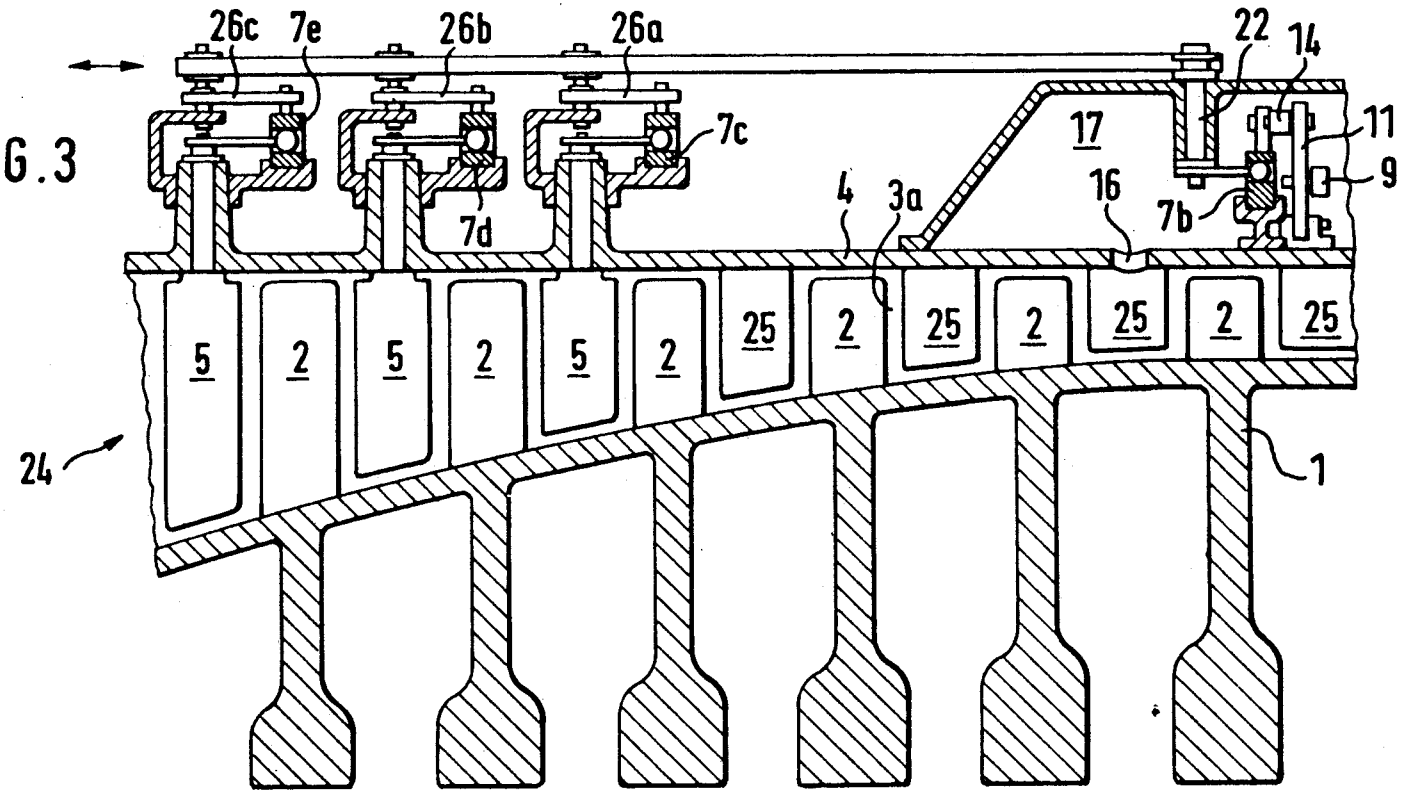
FIG. 3 is a longitudinal sectional schematic view of the high-pressure compressor of FIG. 2.

FIG. 3 shows the method of operation of the push rod 23 which, on one side, is connected with one adjusting ring 7*b* and, on the other side, is connected with various adjusting rings 7*c*, 7*d*, 7*e*. In this case, the adjusting ring 7*b* is connected with the adjusting arrangement according to the invention, with the difference that no guide blades are adjusted directly by adjusting ring 7*b*, but that only an adjusting signal is received from adjusting ring 7*b*.

The shown compressor 24 has a flow duct 3*a* which narrows down in the axial direction, compressor blades 2 and guide blades 5 or 25 being provided alternately. In this case, the guide blades 5 which are in front in the flow direction can be adjusted, whereas the rear guide blades 25 are rigidly connected to the flow duct wall 4.

A portion of the working gas flows from the flow duct 3*a*, by way of openings 16 distributed at the circumference, into the outer space 17, whereby the expansion rod 9 mounted there takes on a length corresponding to the temperature. By means of the step-up lever 11 which is rotatably supported at the flow duct wall 4 which also expands corresponding to its temperature, and by means of the connecting shaft 14, this differential length change is transmitted to adjusting ring 7*b*. By way of the shaft 22, the push rod 23 is connected to the adjusting ring 7*b*, this push rod 23 as a result moving essentially in its axial direction.

As shown in FIG. 3 in connection with FIG. 4, several L-shaped adapting levers 26*a*, *b*, *c* are linked to the push rod 23. The second lever arms of these adapting levers by way of forks 27 are connected with the adjusting rings 7*c*, 7*d* and 7*e*. By means of the kinematics described in connection with FIG. 1, this movement of the adjusting rings 7*c*, *d*, *e* in the circumferential direction is converted into a swivelling of the guide blades 5. In this case, the ratio of the lever arms of the adapting levers 26*a*, *b*, *c* individually is selected to be such that an optimal adjustment of the pertaining guide blades 5 can be achieved.

The adjustment of the adjusting ring 7 and thus of the guide blade 5, in addition to the thermal control via the electronic engine control unit can take place in such a manner that the expansion rod 9 by means of a connected adjusting gear 28 (FIG. 5) is moved in its axial direction toward the front or the rear. This relative movement to the supporting housing 10 is stepped up by way of the step-up lever 11 and, by means of the connecting shaft 14, is transmitted to the rotating ring 7 so that it is displaced in a defined manner in the circumferential direction. This movement, in turn, by way of the pivoted levers 6, is transmitted to the radial shafts 15 of the guide blades 5, so that the latter are swivelled.

For this purpose, as shown in FIG. 5, a push rod 29 is mounted at the expansion rod 9 in an axially lenghtening manner, this push rod 29 being guided through the supporting housing 10 by way of a bush 30. The adjusting gear 28 itself is fastened to the supporting housing 10 and is controlled by the engine control unit 31. As a result, in addition to the thermal adjusting by the axial displacing of the push rod 29 and thus of the expansion rod 9, a blade adjustment can be superimposed which is controlled or regulated from the outside. In particular, the "rough" adjustment which can be achieved by the thermal adjustment can be finely adjusted, or transient adjustments or fast adjustments can be carried out without the delays which may occur in the thermal control circuit.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for adjusting guide blades in a turbo-engine by means of the thermal expansion of an expansion rod acted upon by working gas which, at one end, is stationarily mounted at a supporting housing and, with its other end, is linked to a step-up device, wherein the expansion rod has a significantly different coefficient of linear expansion with respect to a supporting housing, and wherein the step-up device includes step-up lever means connected with a guide-blade-coupled adjusting ring.

2. An arrangement for adjusting guide blades in a turbo-engine by means of the thermal expansion of an expansion rod acted upon by working gas which, at one end, is stationarily mounted at a supporting housing and, with its other end, is linked to a step-up device, wherein the expansion rod has a significantly different coefficient of linear expansion with respect to a supporting housing, and wherein the step-up device is connected with a guide-blade-coupled adjusting ring, wherein the step-up device is constructed as a step-up lever having a long lever arm and a shorter lever arm, the long lever arm of which is connected with the adjusting ring by way of a connecting shaft linked at both ends.

3. An arrangement according to claim 1, wherein the expansion rod has longitudinal reinforcing ribs to protect against buckling.

4. An arrangement according to claim 2, wherein the expansion rod is aligned in the circumferential direction of the turbo-engine.

5. An arrangement according to claim 2, wherein the step-up lever is constructed to be one-armed and is radially aligned in the turbo-engine.

6. An arrangement according to claim 1, wherein branched-off compressor air flows around the expansion rod.

7. An arrangement according to claim 6, wherein compressor blow-off air flows around the expansion rod.

8. An arrangement according to claim 1, wherein the expansion rod is coupled with several adjusting rings of different compressors or compressor stages.

9. An arrangement according to claim 8, wherein a second adjusting ring is connected by way of a shaft.

10. An arrangement according to claim 8, wherein several adjusting rings are coupled by way of a common push rod, an adapting lever with a defined step-up ratio of its lever arms being provided between each adjusting ring and the push rod.

11. An arrangement according to claim 9, wherein the push rod is constructed to be bendable.

12. An arrangement according to claim 1, wherein the pivot of a stationarily linked end of the expansion rod can be displaced in the expansion direction relative to the supporting housing by means of an adjusting gear.

13. An arrangement according to claim 1, wherein the expansion rod has a lower coefficient of linear expansion than the supporting housing.

14. An arrangement according to claim 13, wherein the expansion rod has a coefficient of linear expansion $<5\times10^{-6}/K$, and the supporting housing has a coefficient of linear expansion $>9\times10^{-6}/K$.

15. An arrangement according to claim 2, wherein the step-up ratio of the lever arms (l/k) of the step-up lever is higher than 3.

16. An arrangement according to claim 13, wherein the expansion rod consists of a nickel base alloy.

17. An arrangement according to claim 13, wherein the expansion rod consists of a ceramic material.

18. An arrangement according to claim 13, wherein the supporting housing consists of one of a titanium base alloy, a chromium nickel copper base alloy, and a cobalt base alloy.

19. An arrangement according to claim 1, wherein the expansion rod is arranged in the area of a high-pressure compressor and, by means of a push rod or shaft, is coupled with adjusting rings of a low-pressure compressor.

20. An arrangement according to claim 1, wherein the expansion rod is used for adjusting a radial compressor.

21. An arrangement according to claim 1, wherein the expansion rod is used for adjusting turbine guide blades.

22. An arrangement for adjusting guide blades in a turbo-engine by means of the thermal expansion of an expansion rod acted upon by working gas which, at one end, is stationarily mounted at a supporting housing and, with its other end, is linked to a step-up device, wherein the expansion rod has a significantly different coefficient of linear expansion with respect to a supporting housing, and wherein the step-up device is connected with a guide-blade-coupled adjusting ring, wherein the step-up device includes a step-up lever pivotally connected in the supporting housing by means of its fulcrum.

23. An arrangement for adjusting guide blade in a turbo-engine by means of the thermal expansion of an expansion rod acted upon by working gas which, at one end, is stationarily mounted at a supporting housing and, with its other end, is linked to a step-up device, wherein the expansion rod has a significantly different coefficient of linear expansion with respect to a supporting housing, and wherein the step-up device is connected with a guide-blade-coupled adjusting ring, wherein the step-up device includes a step-up lever linked directly to the adjusting ring, and two expansion rods which are stationarily mounted at one end are linked to this adjusting ring.

24. An arrangement according to claim 23, wherein both expansion rods have approximately the same coefficient of linear expansion and are arranged on both sides of the step-up lever.

25. An arrangement according to claim 23, wherein the coefficient of linear expansion of one expansion rod is at least twice as large as that of the other expansion rod, and both are arranged on the same side of the step-up lever.

26. An arrangement according to claim 10, wherein the push rod is constructed to be bendable.

27. An arrangement according to claim 3, wherein the expansion rod has a lower coefficient of linear expansion than the supporting housing.

28. An arrangement according to claim 4, wherein the expansion rod has a lower coefficient of linear expansion than the supporting housing.

* * * * *